US007108154B1

(12) United States Patent
Thompson

(10) Patent No.: US 7,108,154 B1
(45) Date of Patent: Sep. 19, 2006

(54) KICK ON SHOE COVERS

(76) Inventor: Dennis Thompson, 4344 S. Kirkman Rd. #606, Orlando, FL (US) 32811

( * ) Notice: Subject to any disclaimer, the term of this patent is extended or adjusted under 35 U.S.C. 154(b) by 0 days.

(21) Appl. No.: 11/136,695

(22) Filed: May 23, 2005

Related U.S. Application Data

(60) Provisional application No. 60/600,173, filed on Aug. 11, 2004.

(51) Int. Cl.
*B65H 1/00* (2006.01)

(52) U.S. Cl. ..... 221/33; 221/28; 221/29; 221/34; 221/45; 221/56; 221/197; 221/282; 220/481

(58) Field of Classification Search ..... 206/494, 206/554; 221/28, 29, 33, 34, 45, 52, 53, 221/56; 220/481; 312/50; 53/384.1, 571
See application file for complete search history.

(56) References Cited

U.S. PATENT DOCUMENTS

| | | | | |
|---|---|---|---|---|
| 2,754,994 | A | 7/1956 | Cole | |
| 3,403,066 | A | 9/1968 | Ikelheimer | |
| 3,419,929 | A * | 1/1969 | Snow et al. | 12/142 R |
| 3,568,881 | A | 3/1971 | Croney | |
| 3,653,539 | A | 4/1972 | Stageberg | |
| 3,696,967 | A | 10/1972 | Moore et al. | |
| 3,775,793 | A * | 12/1973 | Casavant et al. | 12/1 R |
| 4,194,646 | A | 3/1980 | Oglander et al. | |
| 4,598,485 | A | 7/1986 | Joe | |
| 4,616,428 | A * | 10/1986 | Leger | 36/7.1 R |
| 4,928,849 | A * | 5/1990 | Khozai | 221/45 |
| 5,449,090 | A | 9/1995 | Rodriguez | |
| 5,516,398 | A | 5/1996 | Goto | |
| 5,770,008 | A | 6/1998 | Murphy | |
| D404,189 | S | 1/1999 | Watson | |
| 6,035,915 | A | 3/2000 | Garinger | |
| 6,209,227 | B1 | 3/2001 | Swango | |
| 6,328,086 | B1 | 12/2001 | Takahashi et al. | |
| 6,543,075 | B1 * | 4/2003 | Gultekin et al. | 12/1 R |
| 2003/0071051 | A1 | 4/2003 | Martinsen | |

* cited by examiner

*Primary Examiner*—Gene O. Crawford
*Assistant Examiner*—Michael K. Collins

(57) ABSTRACT

An apparatus for assisting an individual in installing shoe coverings. The apparatus comprises a shoe covering casing and an outer casing in which the shoe covering casing is placed. A plurality of shoe coverings are placed within the shoe covering casing and are mounted so that an individual merely needs to place their foot down into the shoe covering casing and move their foot forward, causing a shoe covering to envelop the foot (preferably with a shoe on it). A mounting mechanism within the shoe covering casing continually sets the top shoe covering on the stack of shoe coverings into a position readily capable of accepting shoes so that the shoe coverings can easily envelop these shoes.

6 Claims, 4 Drawing Sheets

KICK ON SHOE COVERS

I. CROSS-REFERENCE TO RELATED APPLICATIONS

This application claims the benefit of U.S. Provisional Application No. 60/600,173, filed Aug. 11, 2004.

II. BACKGROUND OF THE INVENTION

The present invention concerns that of an apparatus for assisting an individual in installing shoe coverings.

III. DESCRIPTION OF THE PRIOR ART

U.S. Pat. No. 6,209,227, issued to Swango, discloses a slip resistant covering for a shoe for sanitary purposes.

U.S. Pat. No. 4,616,428, issued to Leger, discloses a protective slipper for covering a shoe and secured with an elastic band.

U.S. Pat. No. 4,598,485, issued to Joe, discloses a flexible, slip-resistant and disposable cover for a shoe for sanitary purposes.

U.S. Pat. No. D404, 189, issued to Watson, discloses an ornamental design for a shoe cover device.

IV. SUMMARY OF THE INVENTION

The present invention concerns that of an apparatus for assisting an individual in installing shoe coverings. The apparatus comprises a shoe covering casing and an outer casing in which the shoe covering casing is placed. A plurality of shoe coverings are placed within the shoe covering casing and are mounted so that an individual merely needs to place their foot down into the shoe covering casing and move their foot forward, causing a shoe covering to envelop the foot (preferably with a shoe on it). A mounting mechanism within the shoe covering casing continually sets the top shoe covering on the stack of shoe coverings into a position readily capable of accepting shoes so that the shoe coverings can easily envelop these shoes. Furthermore, each shoe covering has anti-skid bottom surfaces to prevent slipping.

There has thus been outlined, rather broadly, the more important features of an apparatus for installing shoe coverings that the detailed description thereof that follows may be better understood and in order that the present contribution to the art may be better appreciated. There are, of course, additional features of the apparatus for installing shoe coverings that will be described hereinafter and which will form the subject matter of the claims appended hereto.

In this respect, before explaining at least one embodiment of the apparatus for installing shoe coverings in detail, it is to be understood that the apparatus for installing shoe coverings is not limited in its application to the details of construction and to the arrangements of the components set forth in the following description or illustrated in the drawings. The apparatus for installing shoe coverings is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for installing shoe coverings. It is important, therefore, that the claims be regarded as including such equivalent constructions insofar as they do not depart from the spirit and scope of the present invention.

It is therefore an object of the present invention to provide an apparatus for installing shoe coverings which has all of the advantages of the prior art and none of the disadvantages.

It is another object of the present invention to provide an apparatus for installing shoe coverings which may be easily and efficiently manufactured and marketed.

It is another object of the present invention to provide an apparatus for installing shoe coverings which is of durable and reliable construction.

It is yet another object of the present invention to provide an apparatus for installing shoe coverings which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
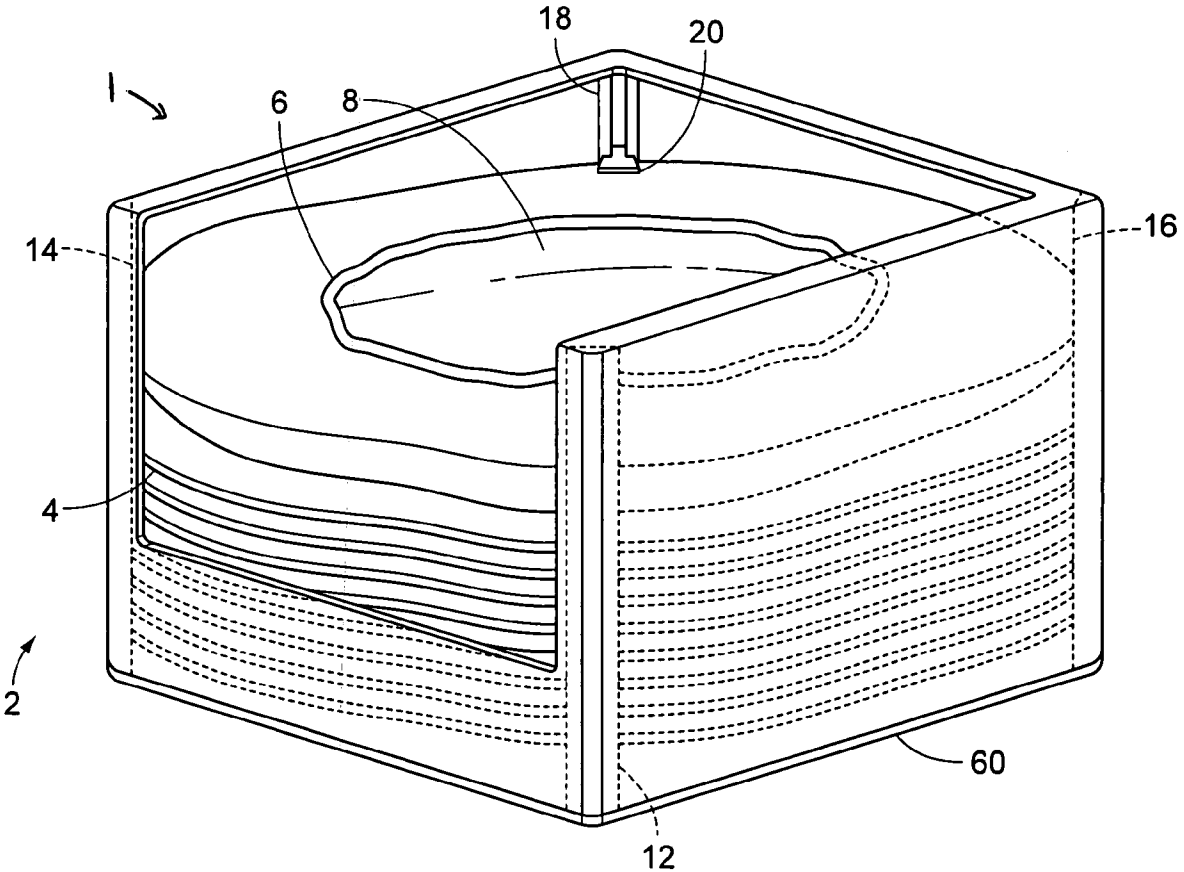
FIG. 1 shows a perspective view of the shoe cover casing.

FIG. 1 shows a perspective view of the shoe cover casing 2 of the present invention 1. Shoe cover casing 2 has four sides comprising a front side, rear side, left side, and a right side. The top surface of the shoe cover casing 2 is open, allowing placement of a shoe inside the actual shoe cover casing 2. Shoe cover casing 2 also has a bottom surface, which has a slip-resistant surface 60 that prevents the present invention from sliding around while in use.

Within shoe cover casing 2 is a volume of folded shoe covers 4 which are stacked on top of each other. Each shoe cover 4 is essentially an ovaloid-shaped entity with a circular elastic liner 6 that surrounds a hole 8. Once the shoe cover 4 wraps around an individual's shoe after the shoe has been placed within the shoe cover 4, the elastic liner 6 surrounds the upper part of a user's shoe, or sometimes even around an individual's ankle, in an effort to securely attach itself to the individual.

Within shoe cover casing 2 is located four tracks comprising a left front track 12, a right front track 14, a left rear track 16, and a right rear track 18. Each shoe cover 4 within the shoe cover casing 2 will be attached to a holding device 20 within each track, with each holding device 20 grasping the shoe cover 4 near the elastic liner 6 that surrounds the hole 8, with the four holding devices 20 comprising a left front holding device 20, a right front holding device 20, a left rear holding device 20, and a right rear holding device 20.

Within the outer shoe cover casing 2, all of the shoe covers 4 will be snugly folded on top of one another, except for the top shoe cover 4. The top shoe cover will be held on the tracks with the holding devices 20 in such a manner that the height difference between the elastic liner 6 and the bottom of the shoe cover 4 (the portion that can roughly be described as being under a person's foot) is about four to six inches. This will ensure that an individual can merely place a shoe down through the top surface of the shoe cover casing 2 and with virtually no effort, have their shoe already located within a shoe cover 4.

Figure 2:
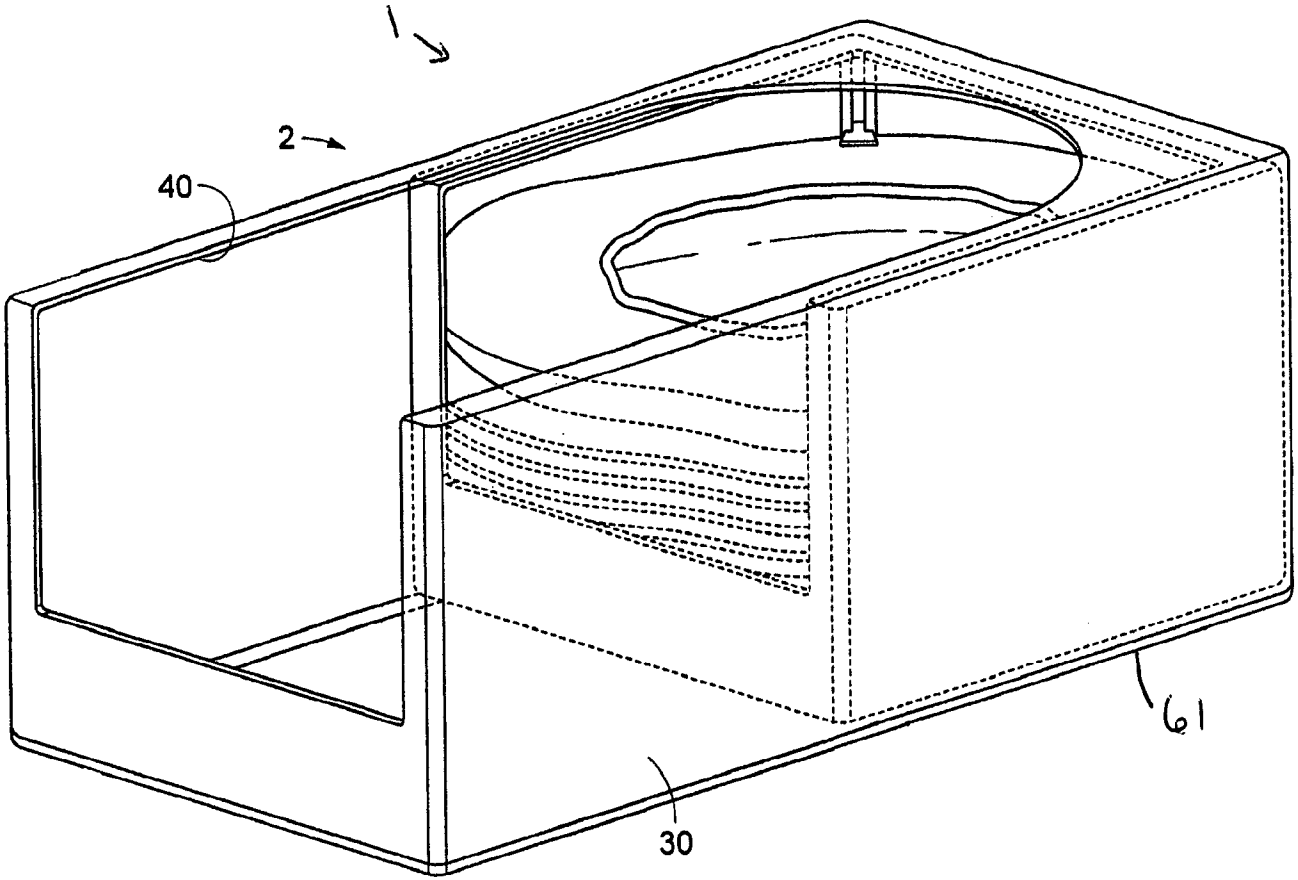
FIG. 2 shows a perspective view of the outer casing in which the shoe cover casing is placed.
Figure 3:
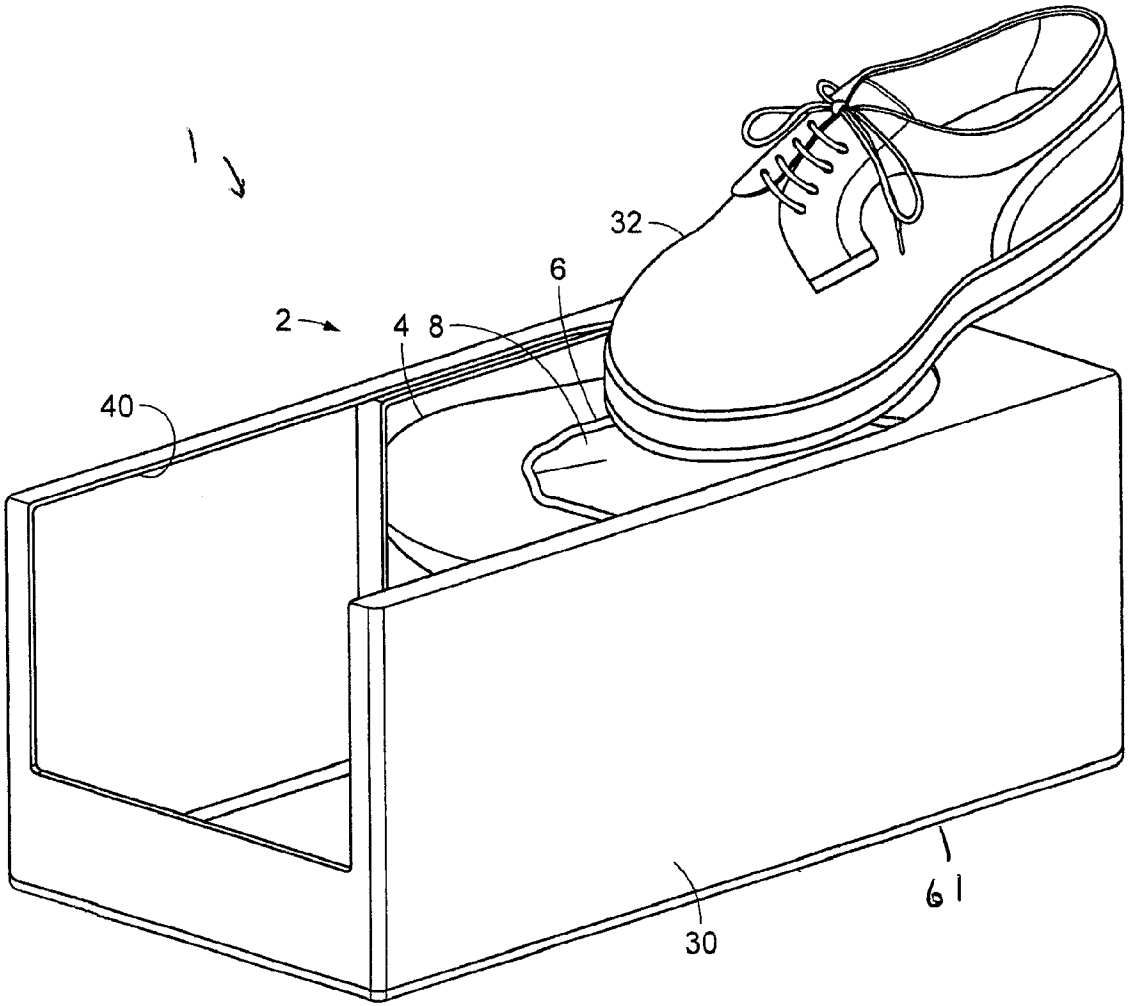
FIG. 3 shows a perspective view of the outer casing and the shoe cover casing as an individual is placing their foot within the shoe cover casing.

FIG. 2 shows a perspective view of the outer casing 30 of the present invention 1 in which the shoe cover casing 2 is placed, while FIG. 3 shows a perspective view of the outer casing 30 and the shoe cover casing 2 of the present invention 1 as an individual is placing a shoe 32 within the shoe cover casing 2. Outer casing 30 has a left side surface, a right side surface, and a rear side surface. In addition, outer casing 30 has two ends, a first end and a second end. Outer casing 30 also has a bottom surface, which has a slip-resistant surface 61 that prevents the present invention from sliding around while in use.

The top of outer casing 30 has a groove 40 which runs lengthwise along the outer casing 30, with the groove 40 having two ends, a first end and a second end. The shoe cover casing 2 is placed within the outer casing 30 underneath the location of the first end of the groove 40. The first end of the groove 40 is oval-shaped to accommodate placement of a shoe within the outer casing 30, while the second end of the groove 40 ends with the second end of the outer casing 30.

As can be seen in FIGS. 2 and 3, an individual merely needs to place a shoe 32 on a foot into the shoe cover 4 that is on the top of the stack of shoe covers 4. Then, once the shoe 32 is located within the shoe cover 4, an individual merely needs to push his or her foot forward through the front side of the shoe cover casing 2, which is partially absent on the upper portion of the shoe cover casing 2. The holding devices 20, once a small amount of forward pressure is applied to them, will release their grasp of the shoe cover 4 being pulled away from them. Once this occurs, an individual merely needs to continue to push their foot forward, with the top of their foot or their ankle going through the groove 40 onward toward the second end of the groove 40 and outer casing 30.

Figure 4:
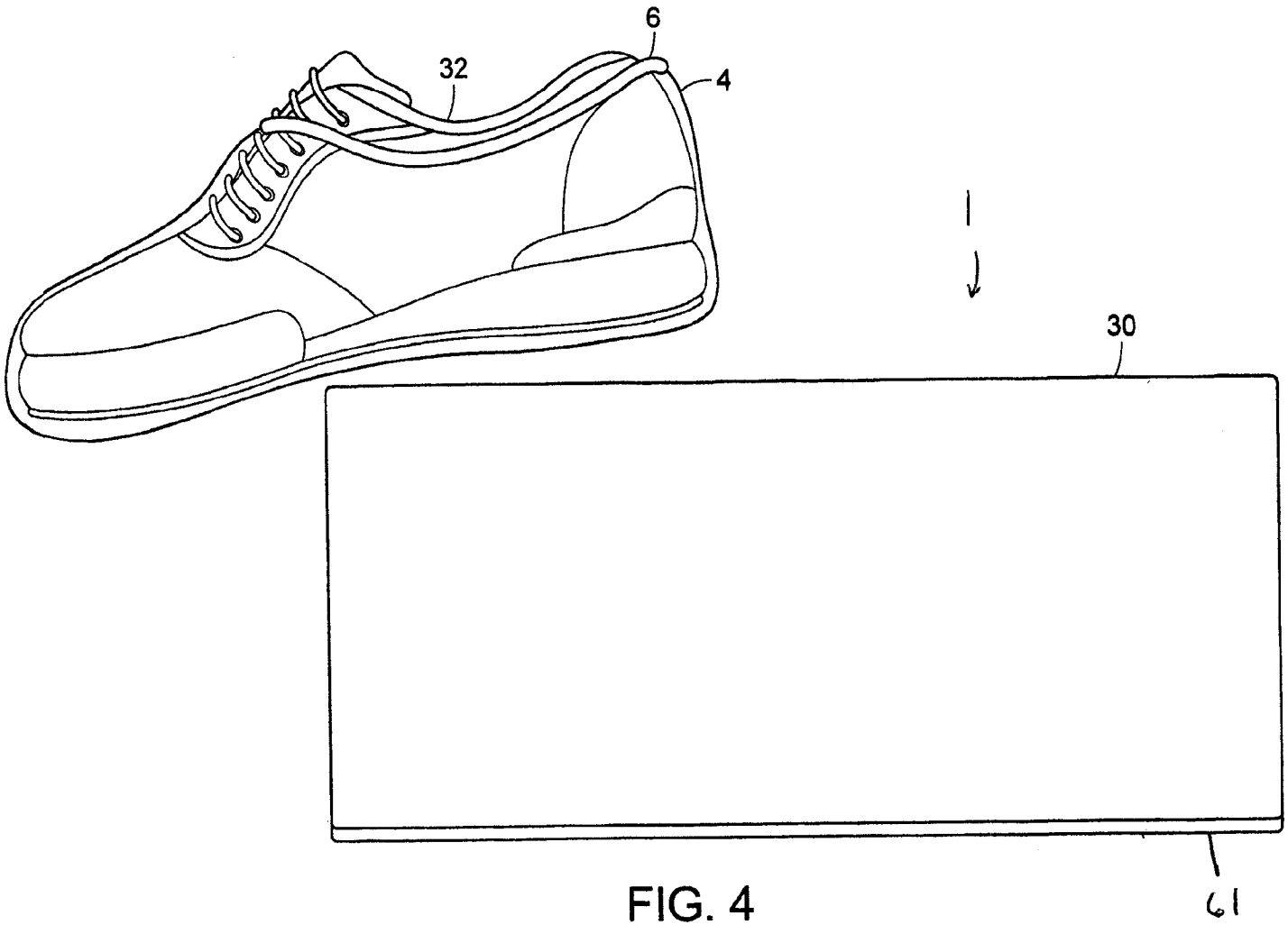
FIG. 4 shows a side view of the outer casing and the shoe cover casing as an individual has moved their foot forward out of the shoe cover casing and outer casing.

FIG. 4 shows a side view of the outer casing 30 and the shoe cover 4 casing as an individual has moved their shoe 32 forward out of the shoe cover casing 2 and outer casing 30. Once an individual moves the shoe with a covered shoe cover 4 from the stack of shoe covers 4, the formerly top shoe cover 4 (the one now attached to a shoe) pulls up the next highest shoe cover 4 on the stack into place on the tracks and the holding devices 20. This will ensure that subsequent shoe covers 4 will be as easy as previous ones to install on an individual's foot.

I claim:

1. An apparatus for assisting an individual in installing shoe coverings comprising:

a shoe cover casing, the shoe cover casing having a front side, a rear side, a left side, a right side, a top surface, and a bottom surface, the top surface of the shoe cover casing having an opening, a quartet of tracks comprising a left front track, a right front track, a left rear track, and a right rear track, a plurality of folded shoe covers located within the shoe cover casing, the folded shoe covers being stacked on top of one another, each of the folded shoe covers being ovaloid-shaped, each of the folded shoe covers having a hole, each of the folded shoe covers also having an elastic liner that surrounds the hole, a quartet of holding devices comprising a left front holding device, a right front holding device, a left rear holding device, and a right rear holding device, the left front holding device being located in the left front track, the right front holding device being located in the right front track, the left rear holding device being located in the left rear track, the right rear holding device being located in the right rear track, an outer casing having a left side surface, a right side surface, a rear side surface, a top surface, and a bottom surface, the outer casing having a first end and a second end, a groove on the top surface running lengthwise along the outer casing, the groove having a first end and a second end, wherein the shoe cover casing is placed within the outer casing underneath the location of the first end of the groove, wherein upon insertion of a shoe into the shoe cover located on the top of the stack of plurality of shoe covers, and further wherein upon pushing the shoe forward through the front side of the shoe cover casing, wherein upon further pushing of the shoe forward until a foot or ankle passes through the groove onward toward the second end of the groove and the outer casing such that the shoe cover clears the shoe cover casing.

2. An apparatus for assisting an individual in installing shoe coverings according to claim 1 wherein the apparatus further comprises a slip-resistant surface attached to the bottom surface of the shoe cover casing.

3. An apparatus for assisting an individual in installing shoe coverings according to claim 1 wherein the apparatus further comprises a slip-resistant surface attached to the bottom surface of the outer casing.

4. An apparatus for assisting an individual in installing shoe coverings according to claim 1 wherein the first end of the groove is oval-shaped to accommodate placement of a shoe within the outer casing, further wherein the second end of the groove ends with the second end of the outer casing.

5. An apparatus for assisting an individual in installing shoe coverings according to claim 1 wherein the top shoe cover on the plurality of folded shoe covers located within the shoe cover casing has a height difference between the elastic liner and the bottom of the shoe cover is approximately four to six inches.

6. A method for installing shoe coverings on the shoe of an individual, the shoe receiving a foot of an individual, the foot attached to an ankle, the method comprising:

providing a plurality of stacked shoe covers within a shoe cover casing, the shoe cover casing having a front side, a rear side, a left side, a right side, a top surface, and a bottom surface;

forming an opening in the top surface of the shoe cover casing;

forming a groove on the top surface, the groove having a first end and a second end;

providing an outer casing having a left side surface, a right side surface, a rear side surface, a top surface, and a bottom surface, the outer casing having a first end and a second end;

positioning the shoe cover casing within the outer casing beneath the location of the first end of the groove;

inserting the shoe into the shoe cover located on the top of the stack of plurality of shoe covers;

pushing the shoe forward through the front side of the shoe cover casing;

continue pushing the shoe forward until the foot or ankle passes through the groove onward toward the second end of the groove and the outer casing; and removing the covered shoe from the shoe cover casing.

* * * * *